United States Patent [19]

Meisen

[11] 4,211,094

[45] Jul. 8, 1980

[54] STEAMING PLANT FOR THE TREATMENT OF CONTINUOUS WEBS OF TEXTILE MATERIAL CONTAINING THERMOPLASTIC SYNTHETIC FIBERS

[75] Inventor: Klaus Meisen, Krefeld, Fed. Rep. of Germany

[73] Assignee: Kleinewefers Gesellschaft mit beschränkter Haftung, Krefeld, Fed. Rep. of Germany

[21] Appl. No.: 840,030

[22] Filed: Oct. 6, 1977

Related U.S. Application Data

[63] Continuation of Ser. No. 660,358, Feb. 23, 1976, abandoned.

[30] Foreign Application Priority Data

Feb. 24, 1975 [DE] Fed. Rep. of Germany ... 7505591[U]

[51] Int. Cl.[2] ..... D06B 3/10; D06B 23/14

[52] U.S. Cl. ..... 68/5 D; 34/66; 34/155; 165/65; 165/120

[58] Field of Search ..... 68/5 D, 5 E; 34/66, 34/67, 155, 156, 158, 159, 160; 118/67, 69; 165/65, 120

[56] References Cited

U.S. PATENT DOCUMENTS

| | | | |
|---|---|---|---|
| 1,768,455 | 6/1930 | Sibson | 34/66 |
| 2,804,694 | 9/1957 | Clipsham | 34/155 X |
| 3,067,602 | 12/1962 | Brunt | 68/5 E |
| 3,560,166 | 2/1971 | Walles | 68/5 D X |
| 3,798,790 | 3/1974 | Roman | 34/160 X |

FOREIGN PATENT DOCUMENTS

| | | | |
|---|---|---|---|
| 869621 | 3/1953 | Fed. Rep. of Germany | 34/156 |

*Primary Examiner*—Philip R. Coe

*Attorney, Agent, or Firm*—Becker & Becker, Inc.

[57] ABSTRACT

A steaming plant for the treatment of continuous webs of textile material which contain thermoplastic synthetic fibers, especially polyacrylic nitrile fibers of the like. The steaming plant includes a steaming chamber and a vat-shaped, bath-free cooling device which when viewing in the direction of movement of the web through the plant is located behind the steaming chamber. Air from the outside passes through the cooling device in a direction opposite to the direction of movement of the web, while between the steaming chamber and the cooling device there is arranged an air or steam floodgate or charging valve lock or seal (also identifiable as air-lock or steam lock as well as air-trap or steam trap) from which conduit means lead to a chimney or flue and/or to a blower.

6 Claims, 1 Drawing Figure

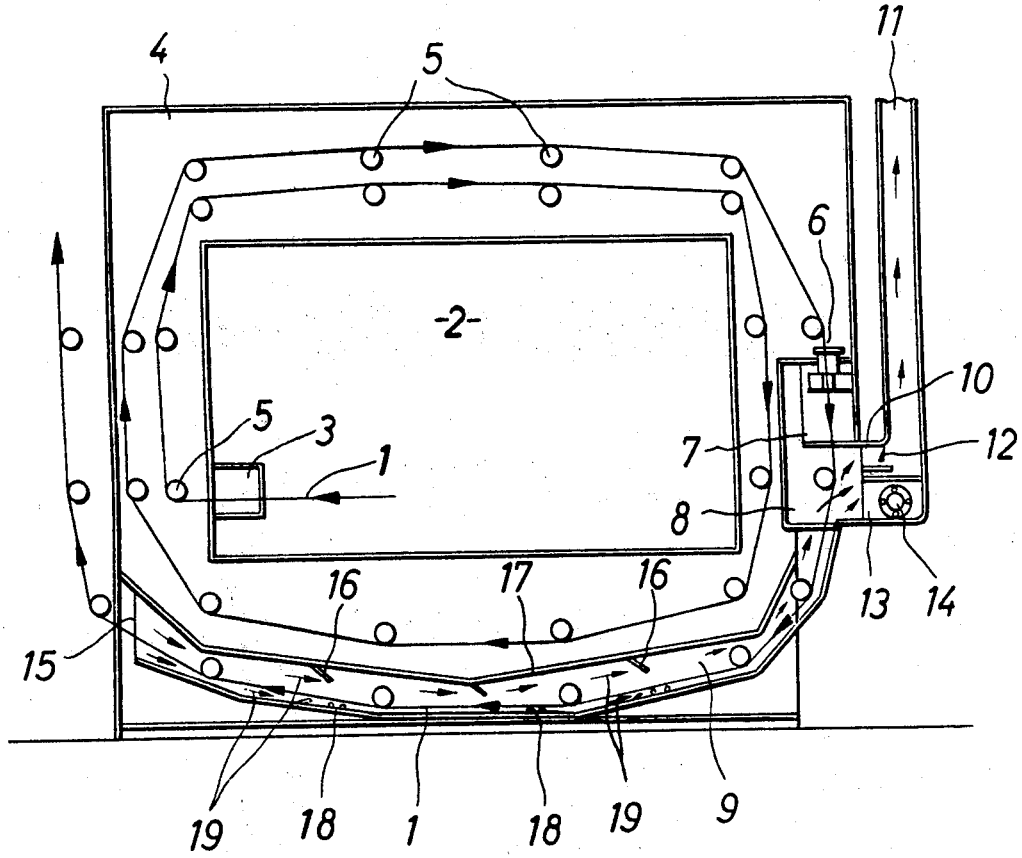
4
5
11
6
-2-
10
5
3
1
7
12
8
16
17
16
13
14
15
19
18
1
18
19
9

STEAMING PLANT FOR THE TREATMENT OF CONTINUOUS WEBS OF TEXTILE MATERIAL CONTAINING THERMOPLASTIC SYNTHETIC FIBERS

This is a continuation of co-pending application Ser. No. 660,358—Meisen, filed Feb. 23, 1976, and now abandoned.

The present invention relates to a steaming plant for the treatment of continuous thermoplsatic synthetic fibers, especially of webs of textile material containing polyacrylic nitrile fibers or the like, by means of a steaming chamber in a vat-shaped cooling device which in the direction of movement of said web of textile material is arranged behind said steaming chamber.

When treating in a steaming chamber webs of textile material which contains thermoplastic synthetic fibers, it has been found that the synthetic fibers are softened by the steam temperature in the steaming chamber up to completely losing their shape and after cooling off remain in this shapeless form. A shock-like cooling of the web of textile material of about 100° C. in the steaming chamber to the outside temperature will in view of the very low glass transformation point of the synthetic fiber bring about the drawback that the synthetic fibers collapse, which is highly disadvantageous, especially with pile fabrics or for instance plush, velvet, carpets, and the like.

It has been suggested gradually to cool to room temperature the web of textile material leaving the steaming plant, and to do this by means of a cooling liquid. To this end, below the steaming plant, a vat-shaped cooling device has been employed which is filled with cooling liquid through which the web of textile material leaving the steaming plant is passed prior to exposing the synthetic fibers to room temperature.

It is, therefore, an object of the present invention to so improve the last mentioned type of steaming plant by means of a cooling device that a more uniform continuous cooling of the web of textile material is obtained, or, expressed differently, a more precise control will be assured during the cooling-off process, while it will not be necessary to expose the web of textile material to a post treatment in such a way that it has to be subjected to a drying process, for instance in a squeezing apparatus.

These and other objects and advantages of the invention will appear more clearly from the following specification in connection with the accompanying drawing illustrating an embodiment of a cooling device according to the invention on a spiral steaming device of a gantry design.

The steaming plant according to the present invention is characterized primarily in that between the steaming chamber and the vat-shaped cooling device through which outside air passes as cooling medium in counter current direction to the direction of the movement of the web of textile material, there is provided an air or steam floodgate or charging valve lock or seal (also identifiable as air-lock or steam-lock as well as air-trap or steam-trap) behind which (when looking in the direction of movement of said web or textile material) there starts a discharge or exhaust means to a chimney and/or a blower.

According to a further development of the invention, the vat-shaped, bath-free cooling device is equipped with guiding plates which are inclined with regard to the web of the textile material and are directed counter to the direction of movement to said web of textile material. Preferably, these guiding plates are adjustable.

According to a still further development of the invention, the vat-shaped bath-free cooling device includes coils of pipe which are adapted selectively to be passed through by the cooling medium.

Within the vat-shaped cooling device the air passing in counter current direction to the direction of movement of the web of textile material absorbs heat from the web of textile material so that the latter is gradually cooled off to the temperature of the outside air. The outside air flowing into the cooling device is additionally heated up also by the wall portions of the steaming chamber.

The heated air is adapted to absorb moisture whereby during the damping or vaporizing of the hot goods within the vat-shaped cooling device, moisture is prevented from depositing on parts of the cooling device and from forming drops which could drop onto the web of textile material.

Referring now to the drawing in detail, a web 1 of textile material passes from the interior chamber 2 of the steaming plant through a sluiceway, floodgate, lock or charging valve seal means 3 into the steaming chamber 4 in which said web is in the direction of the arrows conveyed spirally about supporting and reversing rollers 5 so that the printed-upon or pile-carrying side of the web of textile material will always face toward the outside.

The web of textile material is heated within the steaming chamber 4 to such an extent that its synthetic fibers are plasticized and if the web would suddenly pass out of the steaming chamber, said plasticized synthetic fibers would lose their shape entirely. In order to prevent this, and to assure a gradual controllable cooling of the web of textile material, the said web is in conformity with the present invention, after leaving the steaming chamber 4 passed at nozzle 6 into a sluiceway, floodgate, lock or charging valve seal means 7 behind which (when looking in the direction of movement of the web of textile material) there is arranged an intermediate chamber 8 and past the latter a vat-shaped cooling device 9 through which the web 1 of textile material is passed.

From the intermediate chamber 8, conduit means 10 lead to a chimney or flue stack 11 while in said conduit means 10 there is provided a valve including a control flap 12 or the like. Furthermore, a conduit 13 leads from the intermediate chamber 8 to a transverse flow blower 14 so that the outside air which enters the vat-shaped cooling device 9 at 15 and which heats up when passing through the cooling device 9 and absorbs moisture can be withdrawn selectively through the chimney 11 or through the transverse flow blower 14 while the sluiceway, floodgate, lock or charging valve seal means prevents steam from being withdrawn from the steaming chamber 4.

The vat-shaped cooling device 9 which is arranged at the bottom portion of the steaming plant and which may have the same width as the latter is equipped with adjustable guiding plates 16 which, as shown in the drawing, are inclined toward the web 1 of goods and are directed in a direction counter to the direction of movement of said web of goods. In view of these guiding plates, the flow velocity of the air can be varied in the cooling device 9. The air is heated on one hand by the web 1 of goods and also by the bottom 17 of the steaming chamber 4. For purposes of controlling the temperature in the cooling device 9 and in order to prevent a sudden shock-like cooling off of the web of textile material, heating coils 18 may be provided in the cooling device 9. It is, thus, possible by cooling the flow velocity of the air in the direction of the arrows 19 by the cooling device on one hand and by the heating coils 18 on the other hand to control the cooling of the web of textile material within the cooling device 9.

It is, of course, to be understood that the present invention is, by no means, limited to the specific showing in the drawing, but also comprises any modification within the scope of the appended claims.

What I claim is:

1. A steaming plant for the treatment of a continuous web of pile textile material containing thermoplastic synthetic fibers, especially polyacrylicnitrile fibers, which includes in combination: a steaming chamber adapted to be connected to a supply of steam, a cooling device arranged to receive outside air as cooling medium, supporting and conveying means arranged to said steaming chamber and said cooling device for supporting and conveying the web of textile material to be treated through said steaming chamber and said cooling device, said cooling device being located past said steaming chamber when viewed in the direction of the movement of a web of textile material and having air circulated in the opposite direction to movement of said web, an intermediate chamber between said cooling device and steam chamber through which said web passes and open to flow of air from said cooling device, exhaust means including a flue stack with a passage thereafter from said intermediate chamber and a control flap for fine adjustment in said passage to regulate air flow from said intermediate chamber to said stack for controlling flow of air from said cooling device, and a second exhaust passage in strongly different suction relationship and in immediate vicinity of said control flap from said intermediate chamber and a blower in said second passage.

2. A steaming plant for the treatment of a continuous web of pile textile material containing thermoplastic synthetic fibers, especially polyacrylicnitrile fibers, which includes in combination: a steaming chamber adapted to be connected to a supply of steam, a cooling device arranged to receive outside air as cooling medium, supporting and conveying means arranged in said steaming chamber and said cooling device for supporting and conveying the web of textile material to be treated through said steaming chamber and said cooling device, said cooling device being located past said steaming chamber when viewed in the direction of movement of said web of textile material, said cooling device including a cooling passage for said material in which air circulates through said passage in the direction opposite to the direction of travel of said web, an intermediate chamber between said steaming chamber and said cooling passage through which said web passes from said steaming chamber to said cooling passage, said intermediate chamber being open to said cooling passage, and having an exhaust outlet passage means for air from said cooling passage, and a control flap element in said exhaust outlet passage means for regulating flow of air therethrough, so that air entering said exhaust outlet passage means is heated by relation to said steaming chamber and the web entering the intermediate chamber and cooling passage is cooled gradually until exposure to the cooler air entering said exhaust outlet passage means, said control element in said exhaust outlet passage providing control of flow of air through said cooling passage to regulate the difference in temperature between said steaming chamber and the air in said cooling passage, said passage means including two exhaust outlet passages for air from said cooling passage, a chimney, an exhaust fan, one of said exhaust outlet passages being connected to said exhaust fan, the second exhaust outlet passage being connected to said chimney at the entrance of which is arranged said control flap element for regulating the flow of air through the chimney, the air flow in the cooling passage being regulated by the control flap and/or by the exhaust fan.

3. A steaming plant as claimed in claim 1, in which said cooling device includes a passage along and in heat exchange relation to said steaming chamber, so that said air is heated in passing to said intermediate chamber.

4. A steaming plant according to claim 3, in which said cooling device is vat-shaped and includes guiding plates inclined toward the path and in the direction opposite to the direction of movement of a web to be passed through said cooling device.

5. A steaming plant according to claim 4, in which said guiding plates are adjustable as to their inclination.

6. A steaming plant according to claim 3, in which said cooling device includes coils connected to a source of steam for additionally controlling the cooling of the web to be passed through the cooling device.

* * * * *